US007919166B2

(12) United States Patent
Becker

(10) Patent No.: US 7,919,166 B2
(45) Date of Patent: Apr. 5, 2011

(54) CATIONIC FINISHED TEXTILE MATERIAL AND ITS USE

(75) Inventor: Christoph Becker, Essen (DE)

(73) Assignee: Kornbusch & Starting GmbH & Co. KG, Borken (DE)

( * ) Notice: Subject to any disclaimer, the term of this patent is extended or adjusted under 35 U.S.C. 154(b) by 1005 days.

(21) Appl. No.: 11/548,333

(22) Filed: Oct. 11, 2006

(65) Prior Publication Data

US 2007/0180627 A1 Aug. 9, 2007

(30) Foreign Application Priority Data

Oct. 11, 2005 (DE) ..... 10 2005 049 015

(51) Int. Cl.
*D06M 15/00* (2006.01)
*D06C 11/00* (2006.01)

(52) U.S. Cl. ..... 428/91; 428/96; 428/97; 442/121

(58) Field of Classification Search ..... 428/91, 428/96; 442/121, 152, 153, 157, 158; 510/295, 510/513

See application file for complete search history.

(56) References Cited

U.S. PATENT DOCUMENTS

| | | | | | |
|---|---|---|---|---|---|
| 3,673,110 | A * | 6/1972 | Edwards | 510/513 |
| 3,694,364 | A * | 9/1972 | Edwards | 510/295 |
| 3,816,321 | A * | 6/1974 | Kleinschmidt | 510/295 |
| 4,065,257 | A * | 12/1977 | Coe et al. | 8/602 |
| 4,380,453 | A * | 4/1983 | Claiborne | 8/606 |
| 5,370,760 | A * | 12/1994 | Mori et al. | 156/89.16 |
| 5,478,489 | A * | 12/1995 | Fredj et al. | 510/299 |
| 5,534,182 | A * | 7/1996 | Kirk et al. | 8/137 |
| 5,698,476 | A * | 12/1997 | Johnson et al. | 442/121 |
| 5,881,412 | A * | 3/1999 | Ziskind | 8/159 |
| 5,964,939 | A * | 10/1999 | Fox et al. | 510/516 |
| 6,025,322 | A * | 2/2000 | Boeckh et al. | 510/516 |
| 6,035,473 | A * | 3/2000 | Felstead et al. | 8/159 |
| 6,228,783 | B1 * | 5/2001 | Foster et al. | 442/121 |
| 6,262,011 | B1 * | 7/2001 | Boeckh et al. | 510/475 |
| 6,465,415 | B2 * | 10/2002 | Boeckh et al. | 510/475 |
| 6,521,582 | B2 * | 2/2003 | Masschelein et al. | 510/297 |
| 6,652,166 | B2 * | 11/2003 | Kawasaki et al. | 396/513 |
| 6,833,336 | B2 * | 12/2004 | Panandiker et al. | 442/121 |
| 6,887,524 | B2 * | 5/2005 | Aouad et al. | 427/359 |
| 7,243,513 | B2 * | 7/2007 | Kohlman et al. | 68/205 R |
| 7,256,166 | B2 * | 8/2007 | Catalan et al. | 510/295 |
| 7,659,354 | B2 * | 2/2010 | Song et al. | 526/307 |
| 2002/0143933 | A1 * | 10/2002 | Hind et al. | 709/224 |
| 2003/0118730 | A1 * | 6/2003 | Aouad et al. | 427/294 |
| 2003/0158075 | A1 * | 8/2003 | Panandiker et al. | 510/475 |
| 2005/0106355 | A1 * | 5/2005 | Kohlman et al. | 428/85 |
| 2007/0298209 | A1 * | 12/2007 | Kohlman et al. | 428/95 |
| 2009/0137170 | A1 * | 5/2009 | Luoni et al. | 442/71 |
| 2010/0017973 | A1 * | 1/2010 | Detering et al. | 8/442 |

FOREIGN PATENT DOCUMENTS

| | | | |
|---|---|---|---|
| DE | 543873 | | 1/1932 |
| DE | 697 10 724 | T2 | 12/1997 |
| DE | 198 25 123 | C2 | 2/2000 |
| EP | 0 033 815 | B1 | 3/1986 |
| EP | 0 093 207 | A1 | 11/1993 |
| JP | 03008860 | A * | 1/1991 |
| WO | WO 98/39401 | | 9/1998 |
| WO | WO 99/63142 | | 12/1999 |
| WO | WO 02/10259 | | 2/2002 |
| WO | WO 02/12424 | | 2/2002 |
| WO | WO 2004/067691 | | 8/2004 |

* cited by examiner

*Primary Examiner* — Cheryl Juska

(74) *Attorney, Agent, or Firm* — Henry M. Feiereisen; Ursula B. Day

(57) ABSTRACT

A cationic finished textile material, in particular in the form of a cloth, rag or the like, includes a textile fabric composed of textile fibers, wherein the fibers having a permanent cationic finish, wherein the textile material is at least partly raised. The cationic finished textile material is particularly useful for preventing discolorations and/or graying of textiles in the wash or for preventing depositions of dyes on textiles in the wash.

20 Claims, No Drawings

CATIONIC FINISHED TEXTILE MATERIAL AND ITS USE

CROSS-REFERENCES TO RELATED APPLICATIONS

This application claims the priority of German Patent Application, Serial No. 10 2005 049 015.8, filed Oct. 11, 2005, pursuant to 35 U.S.C. 119(a)-(d), the content of which is incorporated herein by reference.

BACKGROUND OF THE INVENTION

The present invention relates, in general, to a cationic finished textile material. The present invention further relates to the use of a cationic finished textile material for preventing discolorations or greying of textiles during washing.

When textiles are washed, dyes from the textiles regrettably dissolve in the wash liquor as well as the soil and dirt. And there is a risk that dyes regrettably lost into the wash liquor will end up discoloring, staining or tinting other textiles or to be more precise garments present in the wash liquor (for example in a washing-machine drum); an unwanted color transfer from one textile to another with an undesirable discoloration is the consequence, and white and light-colored textiles acquire an unwelcome greyness. In the case of colored, for example patterned (for example striped or dotted) textiles, however, discolorations can also occur within the same textile.

The unwanted color transfer through the so-called bleeding or leaching of textile dyes cannot be prevented by laundry detergent ingredients.

There are a multiplicity of reasons as to why dyes can detach from textiles, so that this problem is a very complex one. To ensure durable coloration of textiles, different fibers require different classes of dye and dyeing processes. If the dyes are not attached to the fibers through a sufficiently firm bond or are incorporated in the fibers as a water-insoluble pigment, they migrate during the wash along the concentration gradient from the dye-rich textile to the dye-lean wash liquor and there they can go on to other textiles and discolor them. This process is temperature dependent. In a washing operation, therefore, the temperature is the most important parameter in that an increasing washing temperature also increases the risk of discoloration. On the other hand, severe soiling can in some instances only be removed by washing at relatively high temperatures.

It thus finally remains to be noted that mobile dyes from colored textiles are the main cause of textiles turning grey and discoloring. As mentioned above, this undesirable transfer of color through the undesired bleeding or leaching of textile dyes can not be prevented by laundry detergent ingredients.

One conventional attempt to solve this problem is to color-sort the textiles in private households before washing in that, for example, reds are only washed with reds, light-colored laundry only with light-colored laundry, etc. But this has the disadvantage that the soiled laundry first has to be collected and stored until there is enough of it to fill a washing-machine drum. In addition, discolorations of multicolored textiles within the same textile cannot be prevented in this way.

Another approach is to trap, intercept or scavenge the dyes which have regrettably been released into the wash liquor. Commercially available, single use cloths, which are based on a fibrous unwoven web (of viscose or of cellulose for example), have a certain affinity for textile dyes and are able to trap or scavenge them in a certain way out of the wash liquor and thereby render them harmless so to speak. Disadvantages of these commercially available cloths to protect against discolorations are, first, that they are merely single use, disposable materials which are only designed for one washing operation, since the material has not been rendered sufficiently robust to survive more than one wash, and secondly that the finish with the "dye scavengers" cannot be engineered such that is available to a sufficient degree for a multiplicity of washing operations.

It would therefore be desirable and advantageous to provide means suitable for preventing the above-described problem of discoloration of textiles in the wash liquor and to obviate prior art shortcomings. It would also be desirable and advantageous to provide an improved textile material capable of obviating the discoloration of textiles present in the wash liquor, in particular of taking up, trapping, intercepting or scavenging regrettably released textile dyes out of the wash liquor and so avoid or prevent any discoloration of the other textiles present in the wash liquor.

SUMMARY OF THE INVENTION

According to one aspect of the present invention, a cationic finished textile material, in particular in the form of a cloth, rag or the like, includes a textile fabric composed of textile fibers which have a permanent cationic finish, wherein the textile material is at least partly raised.

The present invention further provides for the use of the present invention's cationic finished textile material; further advantageous embodiments of the present invention's use are a subject of the respective use subclaims.

The present invention accordingly provides—in accordance with a first aspect of the present invention—a cationic finished textile material, in particular in the form of a cloth, rag or the like, the textile material comprising a textile fabric composed of textile fibers, the fibers having a permanent cationic finish. The cationic finished textile material is characterized in particular by being at least partly raised (i.e. the surface of the textile material is raised as hereinbelow described on one or both of the sides of the textile material).

The present invention's cationic finished textile material is particularly suitable for use in a wash liquor in which it is present together with the textiles to be washed or cleaned, for example in the drum of a washing machine. Owing to the specific properties of the present invention's textile material, namely the presence of a cationic finish in combination with a nap on the textile material, it is particularly suitable for preventing any discoloration of textiles present in the wash liquor, since it is highly capable of durably taking up or trapping, intercepting or scavenging undesirably released textile dyes from the wash liquor. In other words, the present invention's textile material acts as a "dye scavenger" for dye molecules or particles (i.e. textile dyes), which have become detached during the wash from the dyed textiles to be washed and thus are initially present in a free state in the wash liquor. Owing to the effective fixing of these dye molecules or particles present in the wash liquor to the present invention's textile material, use of the present invention's textile material in a wash liquor ensures an effective elimination of undesirably released dyes from the wash liquor, so that these released dyes are no longer able to discolor other textiles present in the wash liquor.

With regard to the configuration of the present invention's textile material in the form of a cloth, rag or the like, this is to be understood as referring to any desired two-dimensional sheetlike structure having limited dimensions, the shape of the present invention's textile material being for example round or preferably essentially rectangular.

The cationic finishing of the present invention's textile material can be effected in a conventional manner. It can take for example the form of a treatment with cationizing agents known per se for this purpose, which will be detailed herein below. The treatment of the present invention's textile material with a cationizing agent can be effected for example in the course of a pad-mangling operation, in which a physical and/or chemical attachment of the cationizing agent to the fibers of the textile fabric can take place, for example via ionic and/or covalent bonds.

According to the present invention, "raising" is in particular to be understood as referring to a nap on the surface of the textile material in particular. Here it is possible in accordance with the present invention that the surface of the textile material is only partially or else preferably completely raised. In an embodiment preferred according to the present invention, the surface is raised completely, i.e. over its entire area. The raising of the present invention's textile material can have been effected one-sidedly or both-sidedly, preferably both-sidedly. In other words, it is in accordance with the present invention for at least one of the two surfaces or sides of the present invention's textile material to be raised or to have been provided with a nap, and it is preferable in accordance with the present invention for both the surfaces or sides to have been raised. The raising can be effected using conventional processes or means. For example, and without any limitation being applied, mechanical raising using a wire brush is possible.

It is a particular feature of the present invention's raising of the textile material according to the present invention that a certain surface area enlargement is achieved thereby, which provides for better and more stable application of the cationizing agent. This is because a larger amount of the cationizing agent can be bound owing to the surface area enlargement, so that altogether a larger number of binding sites for dye molecules to be fixed are present on the textile supporting material or on the present invention's textile material. This provides altogether for a distinctly improved performance capability on the part of the present invention's textile material, since the total amount of dyes which are capable of being taken up per unit area of the present invention's textile material is significantly increased. Altogether, the present invention accordingly provides a cationic finished textile material which, owing to the raising provided for by the present invention, is able to take up from a wash liquor a distinctly increased amount of dyes to be eliminated. Without wishing to be tied down to any one theory, the present invention believes that the surface area enlargement due to the raising is achieved, for example, by the fact that the fibers are partly split at their surface in particular or the fiber spacing at the surface of the present invention's textile material is increased, so that as well as the surface area enlargement and the attendant increase in the number of possible binding places for the dyes to be eliminated the textile material in the post-cationization state also possesses superior accessibility for the released dyes present in the wash liquor.

The amount of cationizing agent used can vary within wide limits, a person skilled in the art being readily able to select the right amounts for a particular application. In general, the cationizing agent is applied or applicated in amounts (dry weight) of 0.001% to 10% by weight, in particular 0.01% to 6% by weight and more preferably 0.1% to 5% by weight, based on the textile fabric to be given a cationic finish.

In an embodiment particularly preferred according to the present invention, the textile fabric of the present invention's textile material comprises natural fibers or preferably consists essentially thereof. The natural fibers are in particular cotton or wool fibers more preferably cotton fibers. The natural fibers, in particular cotton fibers, preferably used according to the present invention have the advantage that they lead to a particularly good exhaustibility or fixation of the cationizing agent, leading to a stable attachment of the cationizing agent to the fibers. The result is a particularly high washing stability on the part of the present invention's textile material, so that it can readily be used at high washing temperatures, for example in the course of a boil wash, and over a multiplicity of washing operations without this leading to any loss or release of the cationizing agent from the present invention's textile material. As mentioned above, the textile fabric of the present invention's textile material is preferably a pure cotton fabric, in particular a woven cotton fabric. However, in accordance with the present invention, it is similarly possible to use so-called cotton blend fabrics which, as well as cotton fibers, comprise synthetic fibers known per se to one skilled in the art, although the cotton fraction of such blend fabrics should preferably be more than 50%.

In the realm of the present invention, the textile fabric of the present invention's textile material can be a woven fabric or a nonwoven fabric. However, it is preferable according to the present invention for the textile fabric to be a woven fabric and more preferably a woven cotton fabric. In an embodiment preferred according to the present invention, the textile fabric is a so-called cotton molten, which is a raised soft fabric consisting of 100% cotton.

With regard to the aforementioned configurations of the textile fabric as a woven fabric or as a nonwoven fabric, these possess a high level of robustness and good sturdiness, so that these fabrics, in particular the woven fabric, are able to withstand the high mechanical stresses during the wash in a wash liquor, in particular in a washing machine (for example alternating directions of rotation on the part of the washing drum, spin drying and the like). The herein preferred configuration of the textile fabric of the invention as a woven or nonwoven fabric leads to a high stability on the part of the present invention's textile material, so that the latter is even configured as a multitrip material or article, i.e. can be used for a plurality of and preferably for up to fifty washing operations. Furthermore, the aforementioned fabrics in the form of a woven or nonwoven fabric are extremely inexpensive and simple to produce.

The textile fabric of the present invention's textile material should have an areal weight of at least 100 g/m$^2$, in particular of at least 150 g/m$^2$, preferably of at least 200 g/m$^2$, more preferably of at least 250 g/m$^2$ and most preferably in the range from 100 to 400 g/m$^2$. Such textile materials are particularly robust, in particular over a multiplicity of washing operations.

According to the present invention, it may further be provided as a way to enhance stability for the edge of the textile material, in particular of the cloth, rag or the like, to be provided with a surrounding seam. The surrounding seam may in a particularly preferred embodiment be a so-called linking seam. The surrounding seam ensures according to the present invention that the edge of the present invention's textile material is additionally stabilized, which leads to a higher load-resisting ability on the part of the present invention's textile material, since the edge region of the present invention's textile material, configured as a cut edge for example, is effectively protected, so that the woven or nonwoven fabric is not destroyed or does not fray in this region under high mechanical stresses in the washing operation.

In a particularly preferred embodiment whereby particularly good results are achieved with regard to the properties of the present invention's textile material as a "color scavenger" in a wash liquor, the textile fabric of the present invention's textile material is a both-sidedly raised woven fabric consisting of cotton, in particular a molten, in particular having 16 to 20 ends per cm and preferably 18 ends per cm, preferably having a yarn linear density of about Nm 34/1, and/or in particular having 14 to 16 picks per cm, preferably 16 picks per cm, preferably having a yarn linear density of about Nm 7/1. In this embodiment particularly preferred according to the present invention, the textile fabric should have an areal weight in the range from 275 to 325 g/m$^2$ and preferably of about 300 g/m$^2$.

The permanent cationic finish of the fibers is brought about by applying or fixing a cationizing agent. Such processes for permanent finishing of the present invention's textile material with a cationizing agent are known as such to one skilled in the art.

For example, the treatment of the present invention's textile material with the cationizing agent can be effected in the so-called exhaust process by treatment of the textile material with the use liquor, i.e. for example with a solution, dispersion or the like, of the cationizing agent. During this operation, the cationizing agent used in the realm of the present invention exhausts, preferably under weakly acidic conditions, uniformly from the use liquor onto the substrate to be treated. This can be followed by a predrying operation, for example by whizzing or squeezing off on a pad-mangle (pad-mangling), and a final drying step, for example at 100 to 160° C. In other words, a certain "impregnation" of the present invention's textile material with the cationizing agent is effected by dipping the textile fabric used for the present invention's textile material into a bath containing the cationizing agent, followed by a squeezing or drying off of the textile sheet material, followed by a final drying operation at elevated temperatures, in particular as mentioned above. As mentioned above, the cationizing agent becomes fixed on the textile fabric—without wishing to be tied down to any one particular theory—through an attachment to the fibers, and the fixation can be effected by physical and/or chemical processes, for example through formation of ionic and/or covalent bonds between the fibers on the one hand and the cationizing agent on the other. It is therefore preferred according to the present invention to use fiber-reactive cationizing agents.

The cationizing agents used in the realm of the present invention are compounds which are well known as such from the prior art and which are familiar per se to one skilled in the art. In general, the cationizing agent used according to the present invention is an organic polymer comprising cationic charges, preferably a fiber-reactive polymer capable of attaching to the fibers of the textile sheet material in the aforementioned manner. Such a cationizing agent should have a high affinity for anionic substances, in particular anionic dyes. An example of the cationizing agent includes a linear or branched organopolysiloxane-polyammonium block copolymer (B) comprising: 1 to 20 recurring organopolysiloxane blocks (S), and 1 to 20 recurring polyammonium blocks (Q), wherein the blocks (S) and (Q) are disposed in an alternating arrangement.

The organopolysiloxane blocks (S) of the textile material have the meaning

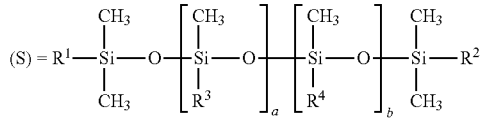

wherein the radicals $R^1$, $R^2$ and $R^4$ when present as end groups of the organopolysiloxane-polyammonium block copolymer (B) have the structure

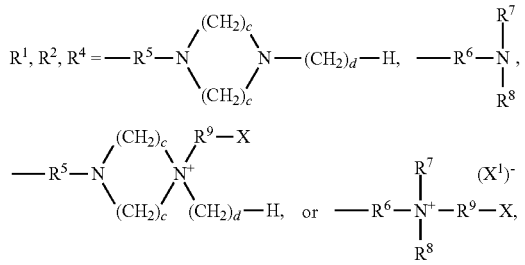

wherein the radicals $R^1$ and $R^2$ are optionally also trimethylsiloxy groups, and wherein the radicals $R^1$, $R^2$ and $R^4$ when present as bridges from the organopolysiloxane blocks (S) to the polyammonium blocks (Q) have the structure

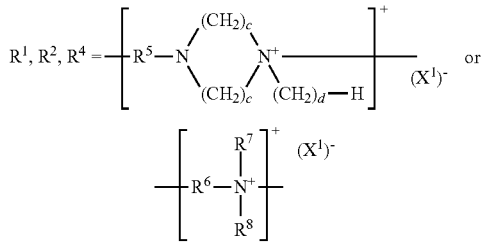

wherein

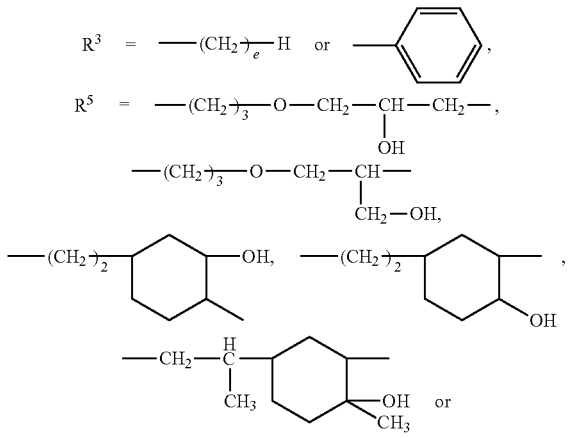

-continued

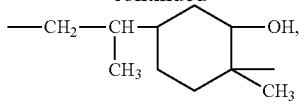

wherein $R^6$ is one of the radicals defined in relation to $R^5$ or

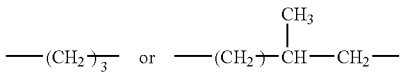

wherein $R^7$ and $R^8$ are identical or different, linear or branched alkyl radicals having 1 to 4 carbon atoms, wherein a is an integer from 5 to 200, b is an integer from 0 to 5, c is an integer 2 or 3, d is an integer from 1 to 18, e is from 1 to 10, and wherein the units provided with the indices a and b form a random distribution, the polyammonium blocks (Q) have the meaning

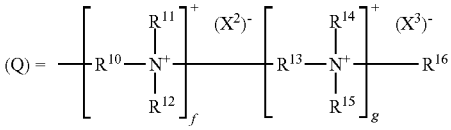

wherein f and g are integers from 0 to 50 subject to the proviso that the sum total of f and g is at least 1 and the units provided with the indices f and g form a random and/or alternating arrangement, and wherein, $R^{16}$ when present as an end group of the organopolysiloxane-polyammonium block copolymer (B) has the structure

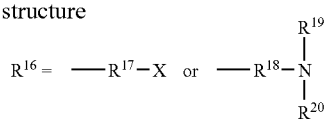

and wherein the $R^{16}$ radical when present as a bridge from the organopolysiloxane blocks (S) to the polyammonium blocks (Q) has the structure $R^{16}$—$R^{21}$—, wherein $R^9$, $R^{10}$, $R^{13}$, $R^{17}$, $R^{18}$and $R^{21}$ are identical or different radicals having the meanings

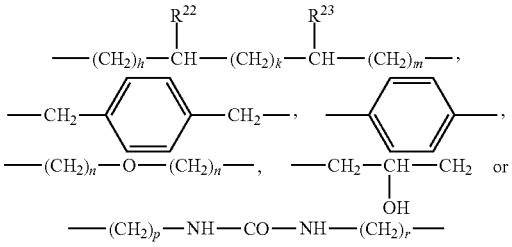

and wherein $R^{22}$ and $R^{23}$ are a hydrogen atom or identical or different, linear or branched alkyl radicals having 1 to 18 carbon atoms, h, k and m are each an integer from 0 to 18 subject to the proviso that the sum total of h, k and m is not more than 18, n, p and r are each an integer 2 or 3, $R^{11}$, $R^{12}$, $R^{14}$, $R^{15}$, $R^{19}$and $R^{20}$are identical or different and represent a linear or branched alkyl group or hydroxyalkyl group having 1 to 12 carbon atoms, a cycloaliphatic group having 5 to 8 carbon atoms or a benzyl group $(x^1)^-$, $(x^2)^-$and $(X^3)^-$are independently Br and/or Cl and X in each occurrence is independently —Br or —Cl and a total nitrogen content of the organopolysiloxane-polyammonium block copolymer (B) is in the range from 2.0% to 7.0% by weight, based on the overall composition of the organopolysiloxane-polyammonium block copolymer (B).

The cationizing agent includes an organopolysiloxane which bears quaternary ammonium groups and is of the type

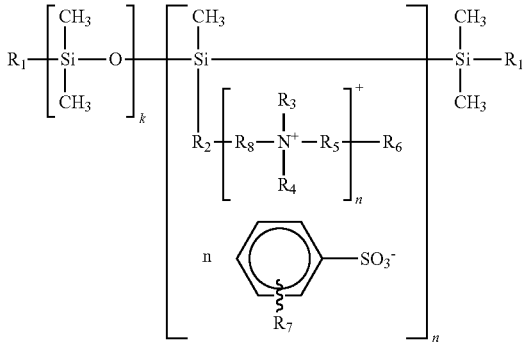

wherein $R_1$ is a hydroxyl, methoxy, ethoxy or methyl radical, $R_2$ is an alkylene radical with $C_1$ to $C_{16}$, $R_3$ and $R_4$ are independently an aliphatic, straight-chain, branched or cyclic alkyl radical with $C_1$ to $C_6$, $R_5$ and $R_8$ are independently an alkylene radical with $C_1$ to $C_6$, $R_6$ and $R_7$ are independently hydrogen or an aliphatic, straight-chain, branched or cyclic alkyl radical with $C_1$ to $C_6$, n is 1 or 2, the sum total of k and m is in the range from 25 to 900 and the m units bearing quaternary ammonium groups may be randomly distributed within the organopolysiloxane, preferably with the proviso that the nitrogen content is in the range from 0.05% to 1.5% by weight, based on the polymer, wherein the organopolysiloxane bearing quaternary ammonium groups additionally bears in the molecule groups of the following structure of the following formula (1.1):

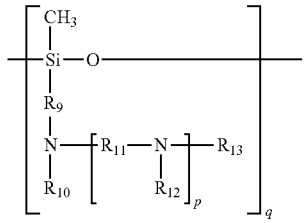

wherein $R_9$ is an alkyl radical with $C_2$ to $C_{22}$, $R_{10}$ and $R_{12}$ are independently hydrogen or an aliphatic, straight-chain, branched or cyclic alkyl radical with $C_1$ to $C_6$, $R_{11}$ is an alkylene radical with $C_2$ to $C_{12}$, $R_{13}$ is hydrogen or an aliphatic, straight-chain or branched alkylene radical with $C_1$ to $C_{12}$, or a cycloalkylalkyl radical with up to $C_{12}$, P is 0 or 1, the sum total of k, m and q is in the range from 25 to 900 and q is not more than m, and the units of the formula (1.1) may be randomly distributed within the organopolysiloxane, preferably with the proviso that the nitrogen content of the polymer modified by the unit (1.1) is in the range from 0.05% to 1.5% by weight, based on the polymer.

The cationizing agent additionally bears amino-containing organopolysiloxanes of the type of the following formula (1.2):

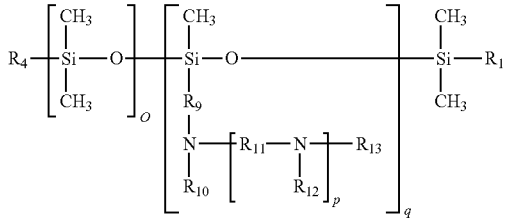

wherein $R_1$ is a hydroxyl, methoxy, ethoxy or methyl radical, $R_9$ is an alkylene radical with $C_2$ to $C_{22}$, $R_{10}$ and $R_{12}$ are independently hydrogen or an aliphatic, straight-chain, branched or cyclic alkyl radical with $C_1$ to $C_6$, $R_{11}$ is an alkylene radical with $C_2$ to $C_{12}$, $R_{13}$ is hydrogen or an aliphatic, straight-chain or branched alkyl radical with $C_1$ to $C_{12}$, or a cycloalkylalkyl radical with up to $C_{12}$, p is 0 or 1, the sum total of o and q is in the range from 25 to 900 and the q amino -containing units may be randomly distributed within the organopolysiloxane, preferably with the proviso that the nitrogen content of this component (1.2) is in the range from 0.1% to 2.5% by weight, based on the polymer (1.2); and also comprises compounds of the following formula (1.3):

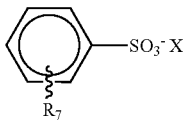

wherein $R_7$ is hydrogen or an aliphatic, straight-chain, branched or cyclic alkyl radical with $C_1$ to $C_6$, X is an aliphatic, straight-chain, branched or cyclic alkyl radical with $C_1$ to $C_6$.

One of the cationizing agent includes a partly quaternized amino-functional organopolysiloxane of the general formula

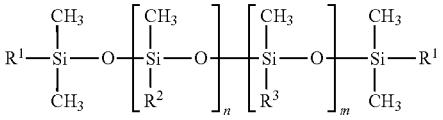

wherein

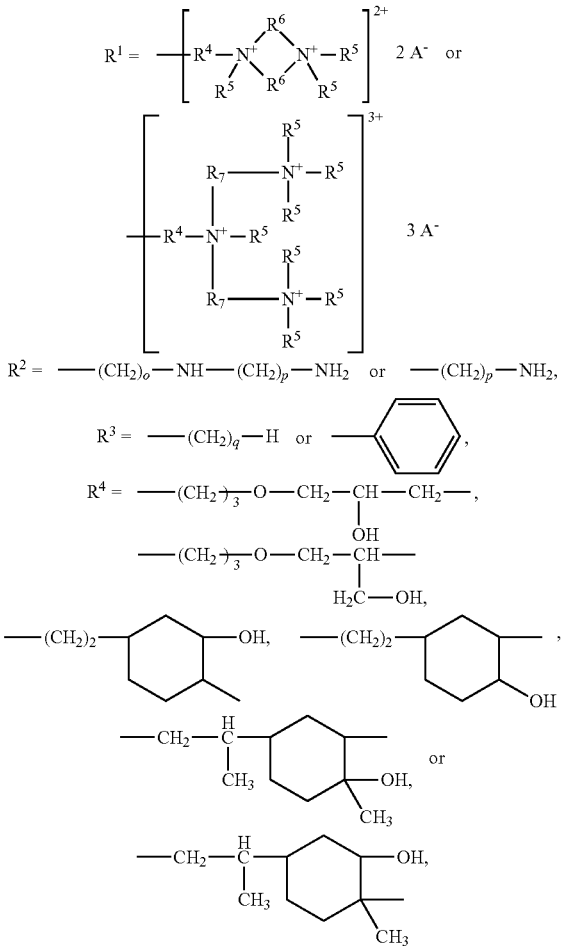

wherein $R^5$ =—$(CH_2)_r$—H $R^6$ =—$(CH_2)_s$—, $R^7$ =—$(CH_2)_t$—,

A designates organic or inorganic anions, n is an integer from 1 to 20, m is an integer from 20 to 2000, o, p and q are each an integer from 1 to 10, r is an integer from 1 to 18, s is an integer 2 or 3 and t is an integer from 2 to 5, and the total nitrogen content of the component is in the range from, 0.05% to 2.0% by weight, based on the polymer.

In an embodiment preferred according to the present invention, the cationizing agent may be an organic polymer comprising quaternary ammonium groups. The present invention can utilize in particular cationizing agents based on a copolymer comprising polyammonium blocks. Of particular preference according to the present invention is the use of organopolysiloxane-polyammonium block copolymers as a cationizing agent, in particular those having randomly or else alternatingly disposed blocks of the aforementioned kind.

A person skilled in the art is readily able to select suitable cationizing agents to use for the present invention's textile material.

The present invention further provides—in accordance with a second aspect of the present invention and as an entity to be realized independently as well as dependently—the use of the cationic finished textile material, as previously defined, for preventing discolorations or greying of textiles in the wash or for preventing depositions of dyes on textiles in the wash. In accordance with the present invention's use of the cationic finished textile material, this is to prevent or avoid any transfer of dyes within a wash liquor in particular from one textile to the other, but also within the same textile (for example in the case of multicolored or patterned textiles). It is particularly envisaged according to the present invention's use that the cationic finished textile material according to the invention is present during the washing of textiles in the wash liquor, in particular in the washing drum of a washing machine. In other words, the present invention's cationic finished textile material is so to speak co-washed in the course of its present invention's use like a conventional textile item with further textiles present in the wash liquor—essentially during the entire washing operation. The present invention's use of the cationic finished textile material according to the present invention extends over a wide range. An example of the use is for conventional washes at 30° C. and also for boil washes at 95° C. The cationic finished textile material according to the present invention can be used for any kinds of textiles, for example coloreds and the like, irrespective of the fabric or material properties.

The textile material finished in accordance with the present invention to be cationic and its use have numerous advantages, of which the following are to be mentioned purely by way of example:

- The textile material finished according to the present invention to be cationic effectively prevents any unwanted discoloration of textiles in a wash liquor, in particular by taking up, trapping, intercepting or scavenging undesirably released textile dyes from the wash liquor, so that these are so to speak rendered harmless to other textiles. In other words, the present invention's cationically effective textile material provides effective protection against discolorations.
- The present invention's cationic finished textile material is designed as a multitrip article and can be used for numerous washing operations with altogether—depending on the use type of the present invention's textile material—up to fifty washing operations being realizable. This constitutes not least a distinct cost saving and environmental benefit.
- The present invention's raising of the cationic coated textile material according to the present invention increases its surface area significantly, providing a particularly large ability to take up and fix the cationizing agent to be applied. The textile material finished in accordance with the present invention to be cationic thus has an extremely high take-up capacity for dyes.
- The present invention's cationic finished textile material is extremely robust owing to the materials used and the specific fixing of the cationizing agent, so that the present invention's cationic finished textile material can also be used for example for boil washing at relatively high temperatures.
- The use of the present invention's cationic finished textile material is not limited to certain textiles or fabrics. Thus the present invention's textile material can be used for all varieties of laundry, for example coloreds, underwear, outerwear and the like.
- Finally, the use of the textile material according to the invention is extremely simple, since it is simply placed like a conventional laundry item together with the textiles or garments to be washed into the washing machine or to be more precise into the drum of the washing machine.

Further embodiments, modifications and variations of the present invention will be readily apparent to and realizable by the ordinarily skilled on reading the description without their having to depart from the realm of the present invention.

BRIEF DESCRIPTION OF THE DRAWING

NONE

DETAILED DESCRIPTION OF PREFERRED EMBODIMENTS

The present invention is illustrated by the operative examples which follow and which shall certainly not restrict the present invention in any way.

OPERATIVE EXAMPLES

Operative Example 1

A textile material based on a cotton molten raised on both sides of its surfaces with a wire brush and having an areal weight of about 300 g/m$^2$ and a size of about 35 cm×35 cm and 18 Nm 34/1 ends per cm and 16 about Nm 7/1 picks per cm is provided in the present invention's manner with a permanent cationic finish by means of a cationizing agent based on an organic polymer comprising quaternary ammonium groups. For this purpose, the textile material is treated with a solution or dispersion of the cationizing agent in a so-called exhaust process by treating the textile material with the use liquor, the cationizing agent exhausting during this operation from the use liquor onto the textile material, followed by a predrying operation through whizzing or squeezing off on a pad-mangle and a subsequent drying passage at 100 to 160° C.

The comparison is against a commercially available single trip product for single use which is based on a thin unwoven which has been similarly provided with a permanent cationic finish.

Both the textile materials—not only the inventive cotton cloth but also the prior art unwoven cloth—are each included in the wash liquor of a coloreds wash having a high proportion of red, each wash liquor additionally containing three all white T-shirts.

Following a single wash at 60° C., both the cloths in the different wash liquors—i.e. not only the inventive cloth but also the prior art cloth—exhibit a distinct red coloration, whereas the three all white T-shirts still exhibit an all white color without reddish tint or greying.

The washing operation is repeated three more times and afterwards the result obtained is as follows. Whereas in the comparative test the relatively thin, non-robust unwoven is substantially fibrized and the unwoven structure is on the point of coming undone and the originally white T-shirts have acquired a noticeable reddish tint in the wash liquor, there is no undesirable tinting of the white T-shirts in the case of the present invention's textile cloth, nor does the present invention's textile cloth used show any signs of wear and tear.

Following a further ten washes with the present invention's cloth, it does not show any further signs of wear and tear and, what is more, the white T-shirts still do not exhibit any discolorations whatsoever.

The above operative Example 1 impressively documents the improvement on the part of the present invention's textile material over the prior art. The present invention's textile material is not only more robust and better able to stand up to the rigours of washing, so that it is readily suitable for multiple use, but it is also more efficient with regard to the trapping, intercepting or scavenging of textile dyes released into the wash liquor and thus offers a more efficient prevention of the unwanted discoloration of textiles in the wash liquor.

Operative Example 2

An inventive cotton molten according to operative Example 1 is used. A similar cotton cloth but, unlike the inventive textile material, without nap on its surface is used for comparison.

Both the textile materials are included in a 60° wash in two similar wash liquors of the kind described in operative Example 1.

The washing operation is initially repeated four times. After the altogether fifth washing operation, neither of the two textile materials shows any signs of wear and tear, but they do have a reddish color due to the textile dyes released into the wash liquor, whereas the white textiles (T-shirts) are still a pristine white.

After a further five-fold repetition of the washing operations at 60° C., the textiles washed with the inventive textile material are still free of any discolorations whatsoever—the white T-shirts continue to exhibit a pure white color, although the inventive textile material is stained more strongly red than in the preceding washes (suggesting a take-up of red textile dye from the wash liquor)—, whereas in the case of the comparative textile material without a nap at its surface the white T-shirts now exhibit a distinctly red tint.

The above operative Example 2 impressively documents the improved efficiency on the part of the inventive textile material due to the raising of the surface. This makes it possible to apply larger amounts of the cationizing agent to the surface, so that the durability or use life is distinctly enhanced; that is, the textile material of the present invention is available for distinctly more washing operations.

While the invention has been illustrated and described in connection with currently preferred embodiments shown and described in detail, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

What is claimed is:

1. A cationic finished textile material, the textile material comprising a textile fabric composed of textile fibers which have a permanent cationic finish, wherein the textile material is at least partly raised, wherein a permanent cationic finishing of the fibers is effected by applying and/or fixing at least one cationizing agent, and wherein the cationizing agent comprises a linear or branched organopolysiloxane-polyammonium block copolymer (B) comprising:

1 to 20 recurring organopolysiloxane blocks (S), and 1 to 20 recurring polyammonium blocks (Q), wherein the blocks (S) and (Q) are disposed in an alternating arrangement.

2. The textile material of claim 1, wherein the textile fabric has an areal weight in the range from 100 to 400 g/m$^2$.

3. The textile material of claim 1, wherein the textile fabric is a woven fabric made of cotton and raised on both sides.

4. The textile material of claim 1, wherein the fabric has 16 to 20 ends per cm.

5. The textile material of claim 1, wherein the fabric has a yarn linear density of about Nm 34/1.

6. The textile material of claim 1, wherein the fabric has 14 to 16 picks per cm.

7. The textile material of claim 1, wherein the fabric has a yarn linear density of about Nm 7/1.

8. The textile material of claim 1, wherein the fabric has an areal weight in the range from 275 to 325 g/m$^2$.

9. The textile material of claim 1, wherein the cationizing agent is applied in an amount (dry weight) of 0.001% to 10% by weight, based on the textile fabric to be given a cationic finish.

10. The textile material of claim 1, wherein the cationizing agent is an organic polymer comprising cationic charges.

11. The textile material of claim 1, wherein the cationizing agent is a fiber-reactive polymer.

12. The textile material of claim 1, wherein the cationizing agent is a quaternary ammonium compound.)

13. The textile material of claim 1, wherein the organopolysiloxane blocks (S) have the meaning

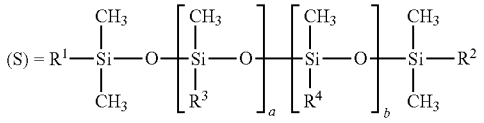

wherein the radicals $R^1$, $R^2$ and $R^4$ when present as end groups of the organopolysiloxane-polyammonium block copolymer (B) have the structure

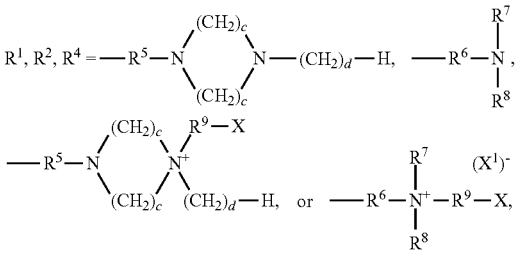

wherein the radicals $R^1$ and $R^2$ are optionally also trimethylsiloxy groups, and wherein the radicals $R^1$, $R^2$ and $R^4$ when present as bridges from the organopolysiloxane blocks (S) to the polyammonium blocks (Q) have the structure

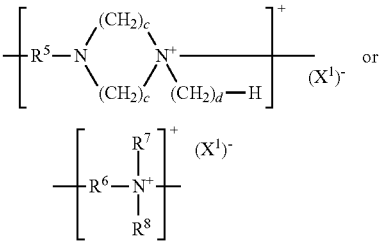

wherein

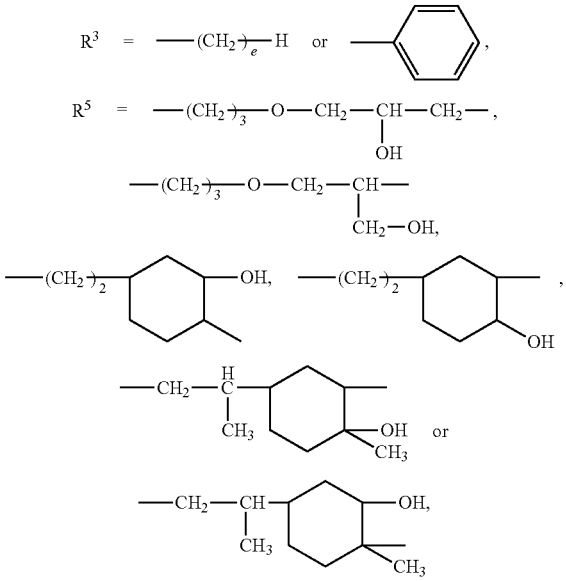

wherein $R^6$ is one of the radicals defined in relation to $R^5$ or

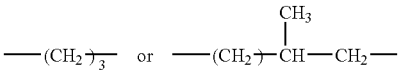

wherein $R^7$ and $R^8$ are identical or different, linear or branched alkyl radicals having 1 to 4 carbon atoms, wherein a is an integer from 5 to 200, b is an integer from 0 to 5, c is an integer 2 or 3, d is an integer from 1 to 18, e is from 1 to 10, and wherein the units provided with the indices a and b form a random distribution, the polyammonium blocks (Q) have the meaning

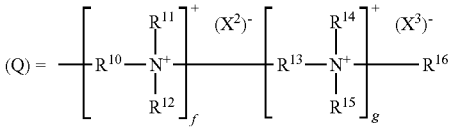

wherein f and g are integers from 0 to 50 subject to the proviso that the sum total of f and g is at least 1 and the units provided with the indices f and g form a random and/or alternating arrangement, and wherein, $R^{16}$ when present as an end group of the organopolysiloxane-polyammonium block copolymer (B) has the structure

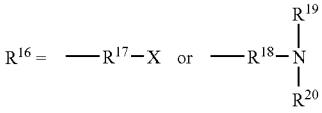

and wherein the $R^{16}$ radical when present as a bridge from the organopolysiloxane blocks (S) to the polyammonium blocks (Q) has the structure $R^{16}$=—$R^{21}$—, wherein $R^9$, $R^{10}$, $R^{13}$, $R^{17}$, $R^{18}$ *and* $R^{21}$ are identical or different radicals having the meanings

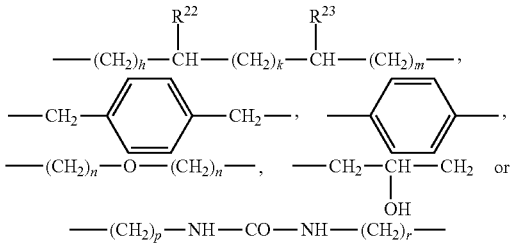

and wherein $R^{22}$ and $R^{23}$ are a hydrogen atom or identical or different, linear or branched alkyl radicals having 1 to 18 carbon atoms, h, k and m are each an integer from 0 to 18 subject to the proviso that the sum total of h, k and m is not more than 18, n, p and r are each an integer 2 or 3, $R^{11}$, $R^{12}$, $R^{14}$, $R^{15}$, $R^{19}$ and $R^{20}$ are identical or different and represent a linear or branched alkyl group or hydroxyalkyl group having 1 to 12 carbon atoms, a cycloaliphatic group having 5 to 8 carbon atoms or a benzyl group $(x^1)^{31}$, $(x^2)^{31}$ and $(x^3)^{31}$ are independently Br and/or Cl and X in each occurrence is independently —Br or —Cl.

14. The textile material of claim 13, wherein a total nitrogen content of the organopolysiloxane-polyammoniurn block copolymer (B) is in the range from 2.0% to 7.0% by weight, based on the overall composition of the organopolysiloxane-polyammonium block copolymer (B).

15. The textile material of claim 1, wherein the cationizing agent comprises an organopolysiloxane which bears quaternary ammonium groups and is of the type

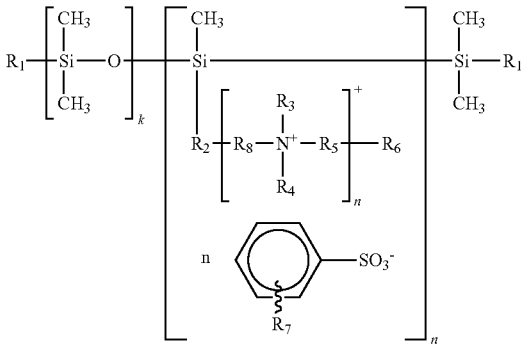

wherein $R_1$ is a hydroxyl, methoxy, ethoxy or methyl radical, $R_2$ is an alkylene radical with $C_1$ to $C_{16}$, $R_3$ and $R_4$ are independently an aliphatic, straight-chain, branched or cyclic alkyl radical with $C_1$ to $C_6$, $R_5$ and $R_8$ are independently an alkylene radical with $C_1$ to $C_6$, $R_6$ and $R_7$ are independently hydrogen or an aliphatic, straight-chain, branched or cyclic alkyl radical with $C_1$ to $C_6$, n is 1 or 2, the sum total of k and m is in the range from 25 to 900 and the m units bearing quaternary ammonium groups may be randomly distributed within the organopolysiloxane, preferably with the proviso that the nitrogen content is in the range from 0.05% to 1.5% by weight, based on the polymer.

16. The textile material of claim 15, wherein the organopolysiloxane bearing quaternary ammonium groups additionally bears in the molecule groups of the following structure of the following formula (1.1):

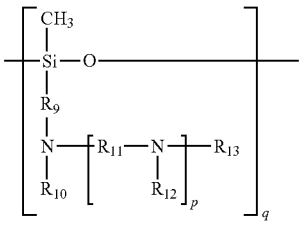

wherein $R_9$ is an alkyl radical with $C_2$ to $C_{22}$, $R_{10}$ and $R_{12}$ are independently hydrogen or an aliphatic, straight-chain, branched or cyclic alkyl radical with $C_1$ to $C_6$, $R_{11}$ is an alkylene radical with $C_2$ to $C_{12}$, $R_{13}$ is hydrogen or an aliphatic, straight-chain or branched alkylene radical with $C_1$ to $C_{12}$, or a cycloalkylalkyl radical with up to $C_{12}$, P is 0 or 1, the sum total of k, m and q is in the range from 25 to 900 and q is not more than m, and the units of the formula (1,1) may be randomly distributed within the organopolysiloxane, preferably with the proviso that the nitrogen content of the polymer modified by the unit (1.1) is in the range from 0.05% to 1.5% by weight, based on the polymer.

17. The textile material of claim 15, wherein the cationizing agent additionally bears amino-containing organopolysiloxanes of the type of the following formula (1.2):

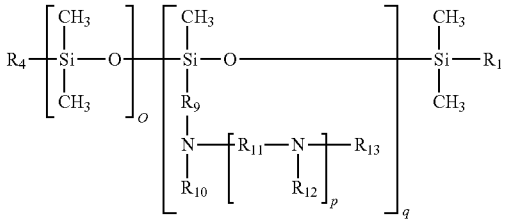

wherein $R_1$ is a hydroxyl, methoxy, ethoxy or methyl radical, $R_9$ is an alkylene radical with $C_2$ to $C_{22}$, $R_{10}$ and $R_{12}$ are independently hydrogen or an aliphatic, straight-chain, branched or cyclic alkyl radical with $C_1$ to $C_6$, $R_{11}$ is an alkylene radical with $C_2$ to $C_{12}$, $R_{13}$ is hydrogen or an aliphatic, straight-chain or branched alkyl radical with $C_1$ to $C_{12}$, or a cycloalkylalkyl radical with up to $C_{12}$, p is 0 or 1, the sum total of o and q is in the range from 25 to 900 and the q amino -containing units may be randomly distributed within the organopolysiloxane, preferably with the proviso that the nitrogen content of this component (1.2) is in the range from 0.1% to 2.5% by weight, based on the polymer (1.2);

and also comprises compounds of the following formula (1.3):

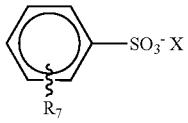

wherein $R_7$ is hydrogen or an aliphatic, straight-chain, branched or cyclic alkyl radical with $C_1$ to $C_6$, X is an aliphatic, straight-chain, branched or cyclic alkyl radical with $C_1$ to $C_6$.

18. The textile material of claim 1, wherein the cationizing agent comprises a partly quaternized amino-functional organopolysiloxane of the general formula

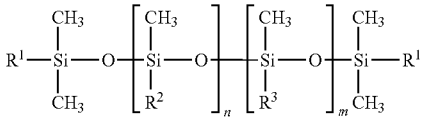

wherein

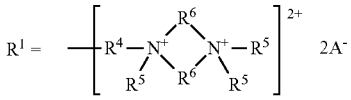

or

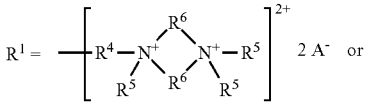

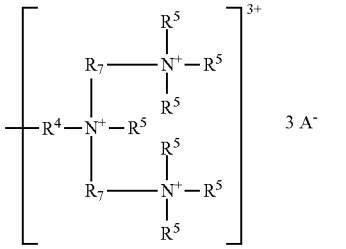

$R^2$ = —$(CH_2)_o$—NH—$(CH_2)_p$—$NH_2$ or —$(CH_2)_p$—$NH_2$, $R^3$ = —$(CH_2)_q$—H or 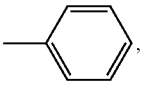 , $R^4$ = —$(CH_2)_3$—O—$CH_2$—CH(OH)—$CH_2$—,

—$(CH_2)_3$—O—$CH_2$—CH($H_2C$—OH)—

-continued

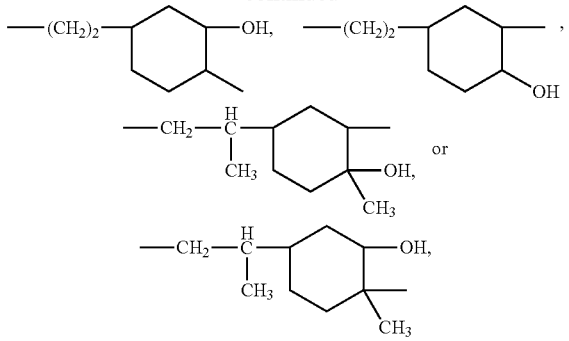

wherein $R^5$ =—$(CH_2)_r$—H $R^6$ =—$(CH_2)_s$—, $R^7$ =—$(CH_2)_t$—,

A designates organic or inorganic anions, n is an integer from 1 to 20, m is an integer from 20 to 2000, o, p and q are each an integer from 1 to 10, r is an integer from 1 to 18, s is an integer 2 or 3 and t is an integer from 2 to 5.

19. The textile material of claim 18, wherein a total nitrogen content of the component is in the range from 0.05% to 2.0% by weight, based on the polymer.

20. The textile material of claim 1 wherein the material is in the form of a cloth or a rag.

* * * * *